US007126050B1

(12) United States Patent
Lombardi

(10) Patent No.: US 7,126,050 B1
(45) Date of Patent: Oct. 24, 2006

(54) CYMBALS OPERATION CONTROL

(75) Inventor: Donald G. Lombardi, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 51 days.

(21) Appl. No.: 10/856,546

(22) Filed: Jun. 1, 2004

(51) Int. Cl.
*G10D 13/02* (2006.01)

(52) U.S. Cl. ..... 84/422.1

(58) Field of Classification Search ..... 84/422.1, 84/422.2, 422.3
See application file for complete search history.

(56) References Cited

U.S. PATENT DOCUMENTS

| | | | | |
|---|---|---|---|---|
| 4,928,567 | A * | 5/1990 | Kurosaki | 84/422.3 |
| 5,088,377 | A * | 2/1992 | Delecaris | 84/422.3 |
| 5,415,072 | A * | 5/1995 | Huang | 84/422.3 |
| 5,438,903 | A * | 8/1995 | Cropek | 84/422.3 |
| 5,668,332 | A | 9/1997 | Lombardi | |

* cited by examiner

*Primary Examiner*—Kimberly Lockett
(74) *Attorney, Agent, or Firm*—William W. Haefliger

(57) ABSTRACT

Cymbals operation control apparatus, comprising a mechanism including a lever, a hook on the lever, and a handle on the lever to achieve release of the upper disc to drop toward a lower cymbals disc, means including a vertically movable upright rod to support the mechanism, and a releasable device to block pivoting of the lever.

12 Claims, 9 Drawing Sheets

20
14
16
10
12
11
13
44a
44

CYMBALS OPERATION CONTROL

BACKGROUND OF THE INVENTION

This invention relates generally to construction and operation of cymbals apparatus, and more particularly to cymbals control apparatus.

During playing of cymbals, it is at times desirable to release an upper cymbals disc to fall toward a lower cymbals disc, for playing of the discs positioned in adjacent relation. There is need for improved apparatus to achieve such upper disc release, and also to achieve upper disc retrieval in order to raise it above the lower disc. This is important, as where two cymbals stands are being operated, and/or where rapid release control is desired as during playing.

SUMMARY OF THE INVENTION

It is a major object of the invention to provide improved means or apparatus meeting the above need, the invention improving upon the invention of U.S. Pat. No. 5,668,332. Basically, the means or apparatus comprises:

a) mechanism including a lever, a hook on the lever, and a handle on the lever to achieve release of the upper disc to drop toward a lower cymbals disc, b) means including a vertically movable upright rod to support said mechanism, c) and a releasable device to block pivoting of the lever.

As will appear, the device may comprise a rotary part such as a pin or a second lever supported to pivot about an axis skewed in relation to the axis of pivoting of the first lever.

Another object includes provision of a first handle on the first lever, and a second handle on the pin or on the second lever for accessibly and easily rotating same.

A further object includes provision of a projection or shoulder on the second lever or on the pin that interferes with first lever pivoting to block pivoting of the first lever. The second lever may typically have a handle spaced from that projection or shoulder, positioned to facilitate ease of rapid tripping of the second lever, as during cymbals playing. The first lever may carry an enlargement or bumper as referred to, to face the second lever projection.

A further object includes provision of a support attached to the rod, and pivotally supporting both the front lever and the releasable device.

Yet another object includes provision of multiple cymbals control apparatus, each apparatus comprising a) mechanism including a lever, a hook on the lever, and a handle on the lever to achieve release of the upper disc to drop toward a lower cymbals disc, b) means including a vertically movable upright rod to support that mechanism, c) and a releasable device to block pivoting of the lever, and a foot pedal operatively connected to each apparatus to move a cymbals disc or discs controllably unblocked by said releasable device or devices.

These and other objects and advantages of the invention, as well as the details of an illustrative embodiment, will be more fully understood from the following specification and drawings, in which:

DRAWING DESCRIPTION

DETAILED DESCRIPTION

Figure 2:
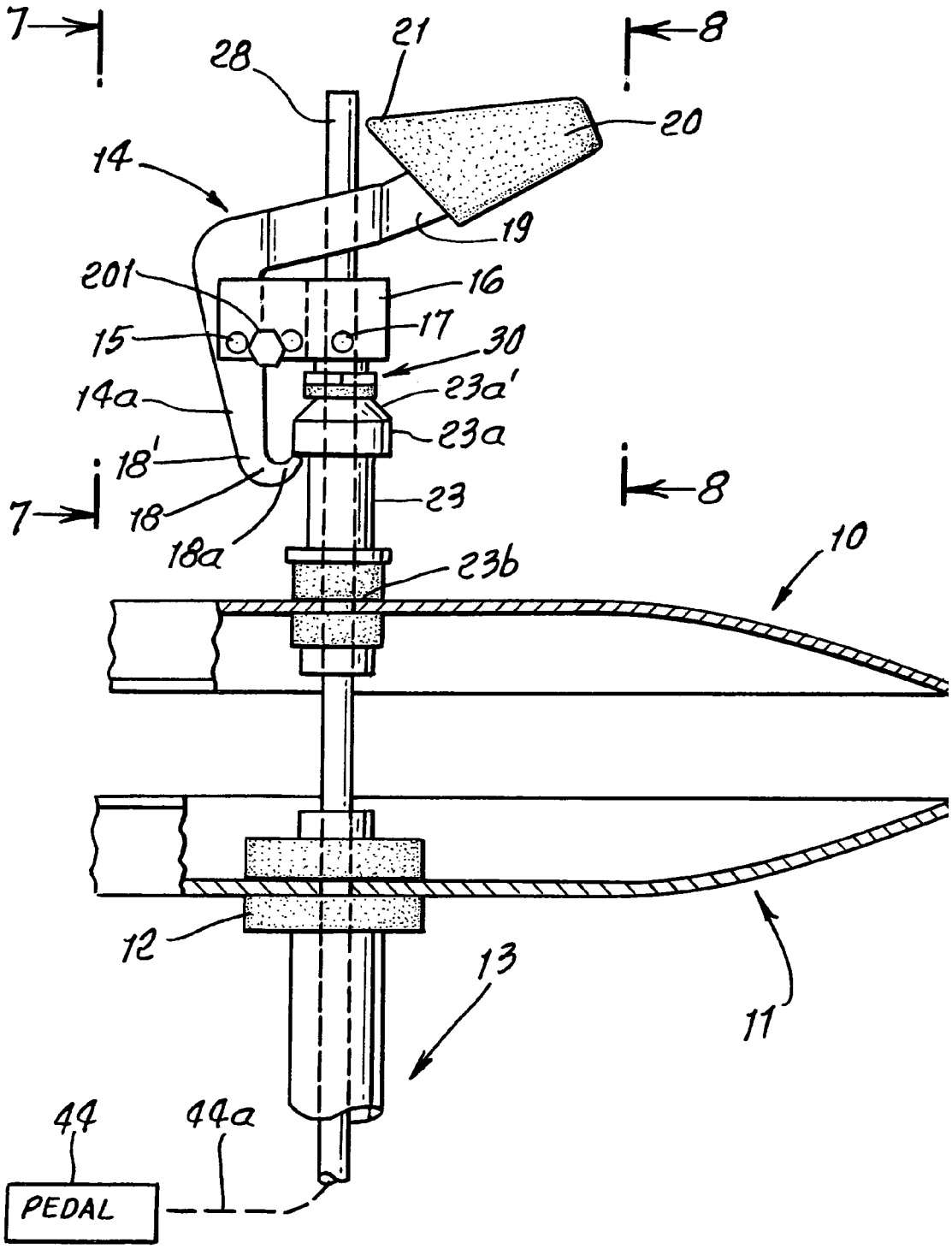
FIG. 2 is an elevation showing the apparatus of a single stand, with the upper cymbals disc elevated.

Referring first to FIG. 2, mechanism is provided to manipulate an upper cymbals disc 10 relative to a lower cymbals disc 11 which has fixed position, i.e. disc 11 does not move up or down. A support 12 for the lower disc is carried by a cymbals stand indicated at 13.

Figure 7:
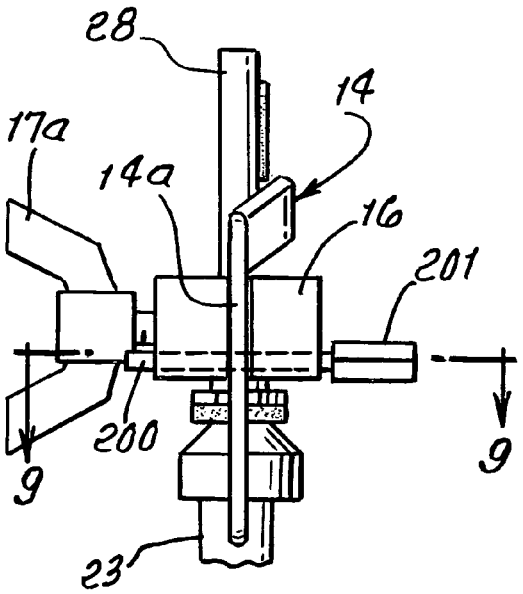
FIG. 7 is an elevation taken on lines 7—7 of FIG. 2.
Figure 8:
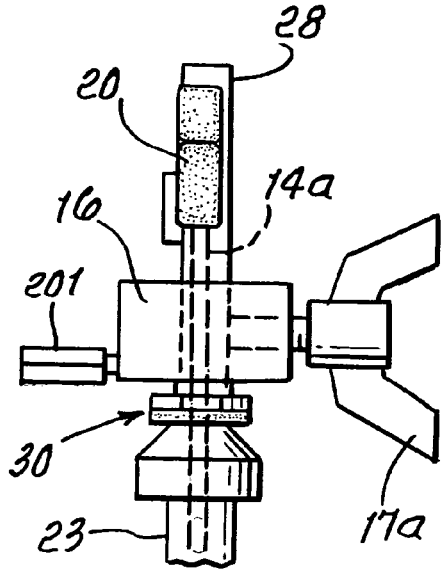
FIG. 8 is an elevation taken on lines 8—8 of FIG. 2.

The mechanism includes a lever 14, pivotally attached at 15 to a block 16. See also FIGS. 3 and 4. The block is attached at 17 to vertical rod 28, which is movable up and down to carry the block and the lever up and down. Part 17 is shown as a set screw carried by block 16 and rotated by a wing nut 17*a*, as seen in FIG. 7 and FIG. 8. Note that pivot 15 is sidewardly offset from the rod and connected to lever leg 14*a*. A hook 18 is provided on the lever and has a terminal 18*a* extending toward the rod.

Figure 3:
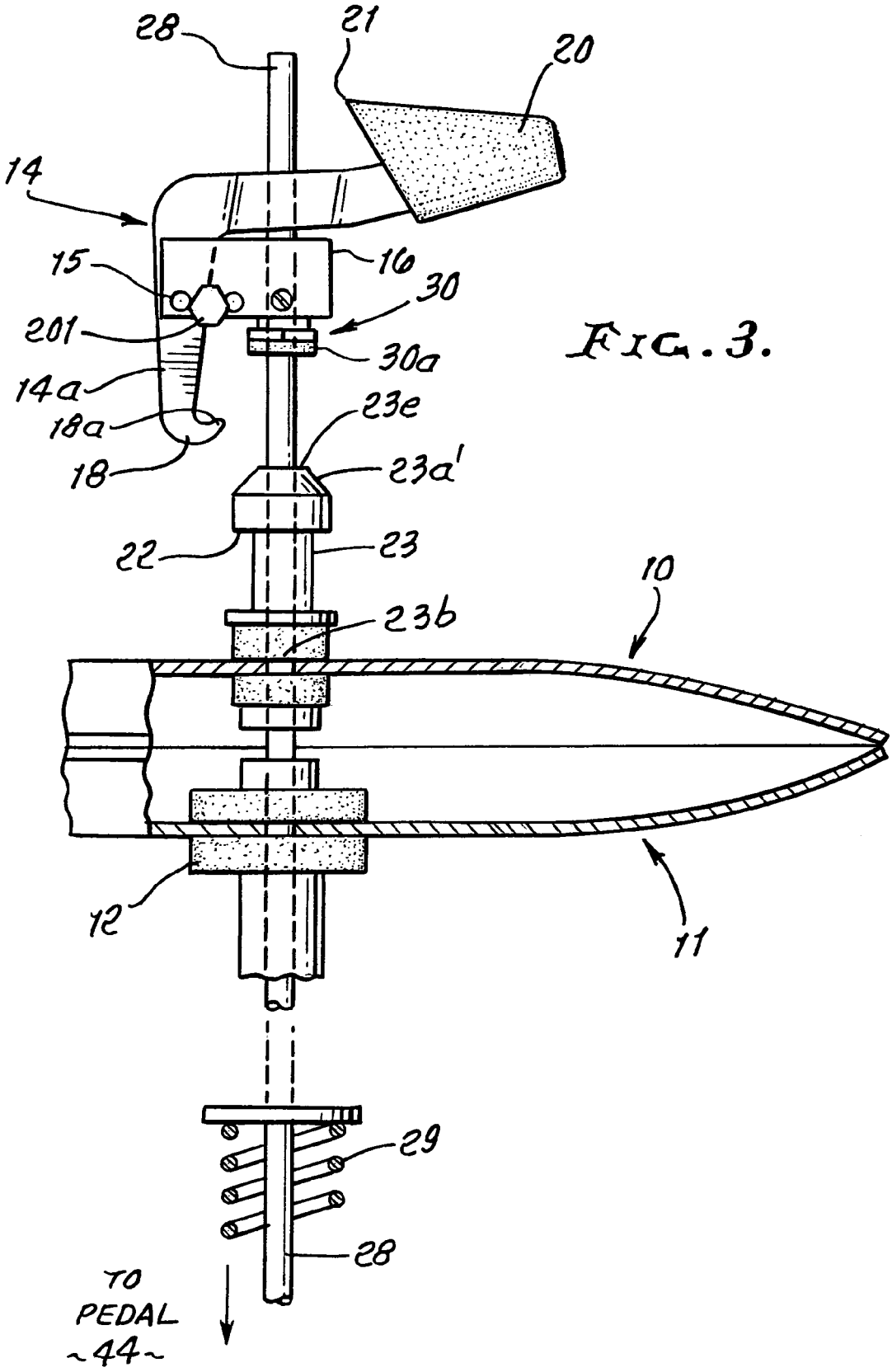
FIG. 3 is a view like FIG. 2 showing the upper cymbals disc released.
Figure 4:
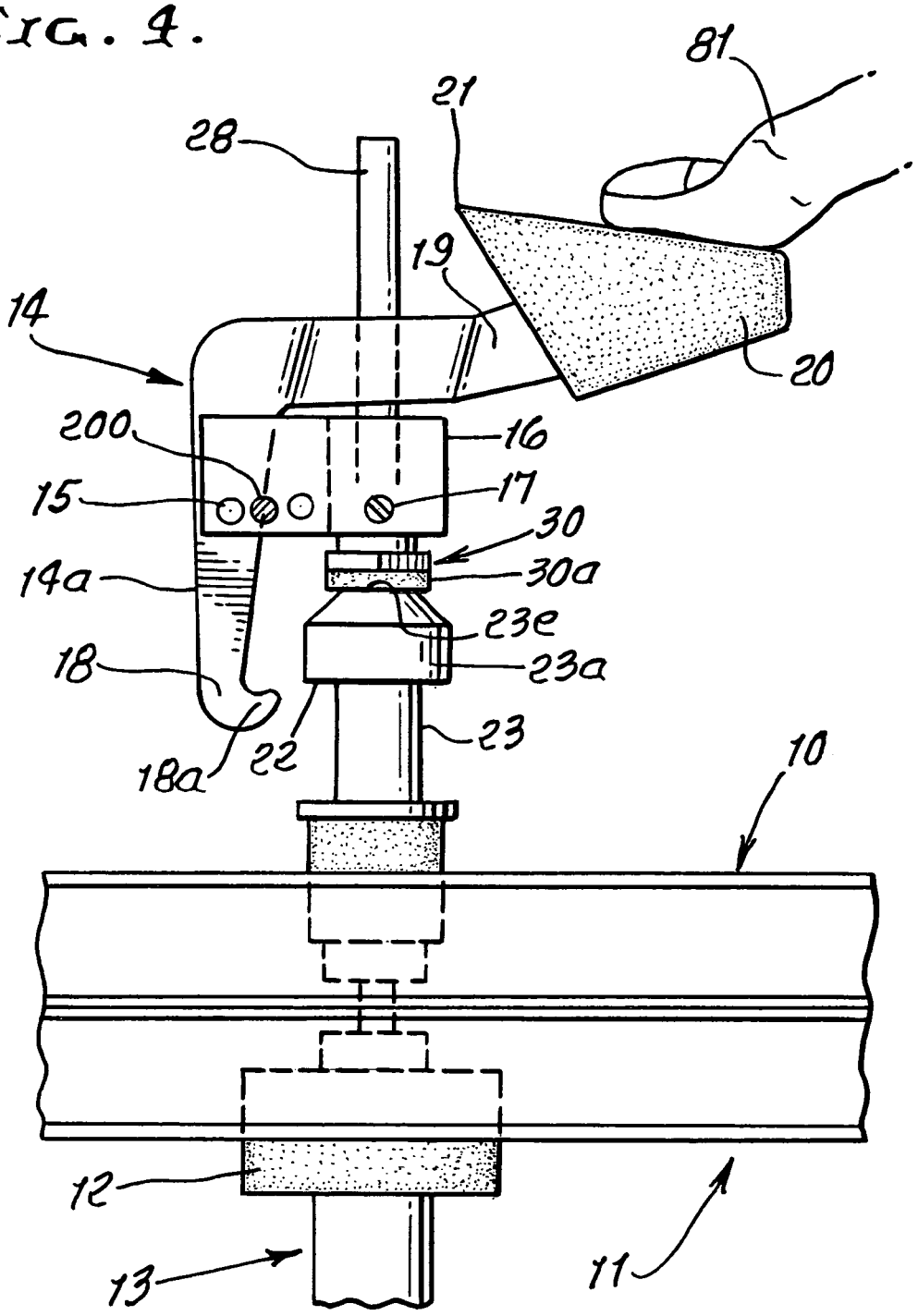
FIG. 4 is an enlarged elevation showing manual release of the upper cymbals disc.
Figure 6:
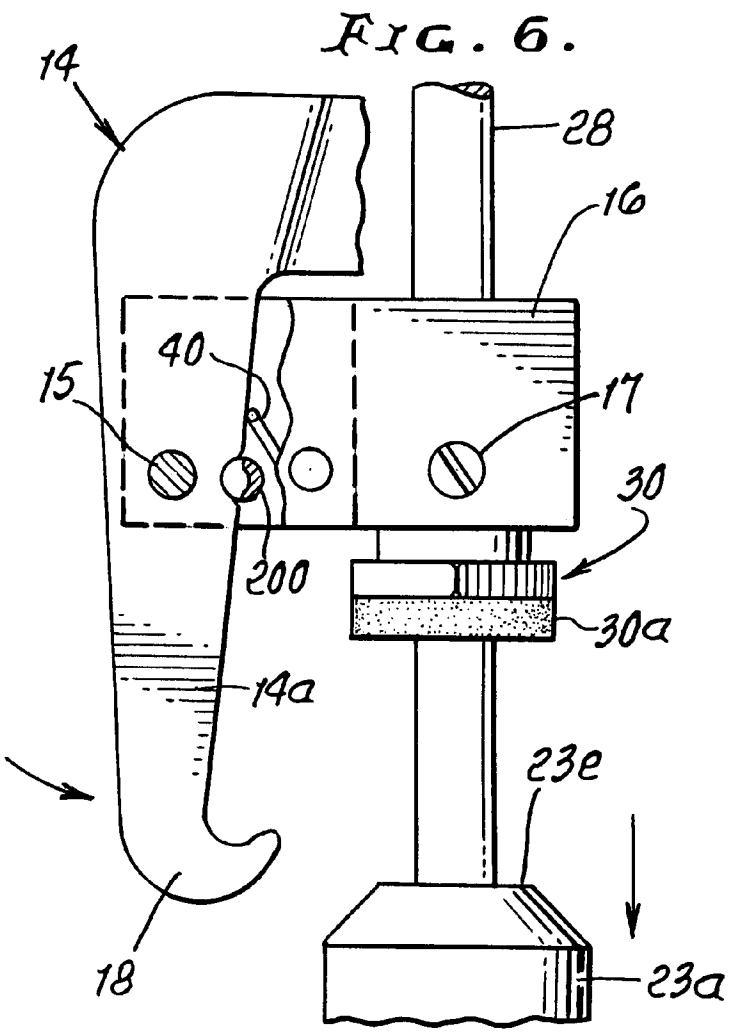
FIG. 6 is a view like FIG. 5, showing sleeve release.
Figure 5:
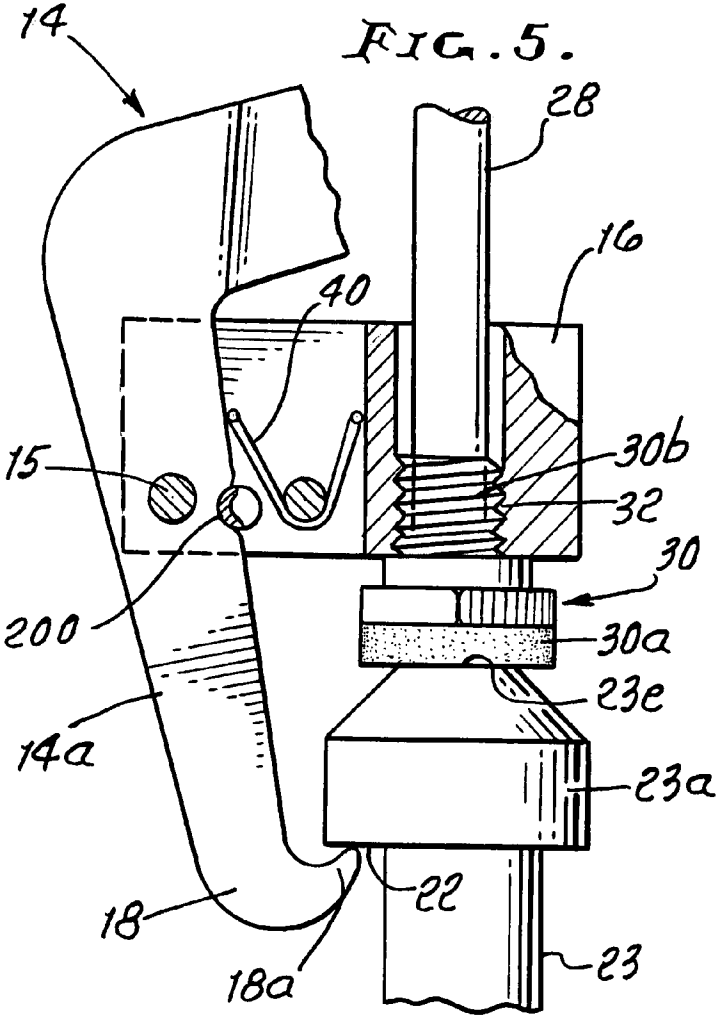
FIG. 5 is an enlarged fragmentary elevation showing lever retention of a cymbals sleeve.

A handle 19 is provided by the lever to extend back across the plane of the rod, and an enlargement such as a bumper 20 is provided on the handle, and may be affixed thereto. The tip or edge 21 of the enlargement bumper facing the rod may be located to be engageable with the rod to provide a stop, limiting counterclockwise pivoting of the lever, thereby preventing tip 18*a* engagement with the rod, in FIG. 3. Spring 40 in FIG. 5 urges the lever counterclockwise. In this regard, the bumper, or at least its tip 21, may consist of rubber or other elastomeric material, or synthetic material, the objective being to prevent audible clicking engagement of that tip with the rod. The bumper is also large enough to be easily manually depressed, in a clockwise direction, as seen in FIG. 4. See user's finger 81.

Such clockwise movement causes the lever hook 18 to move free of a downward facing shoulder 22 on an enlargement 23*a* on sleeve 23. The sleeve carries the upper disc 10, as at 23*b* and is slidable up and down on the rod. Therefore, when the sleeve is released, the disc 10 is also released to drop with the sleeve. FIG. 3 shows the upper disc 10 in downwardly released position and peripherally extending adjacent the lower disc 11, whereby the drummer may play both discs, simultaneously.

Figure 1:
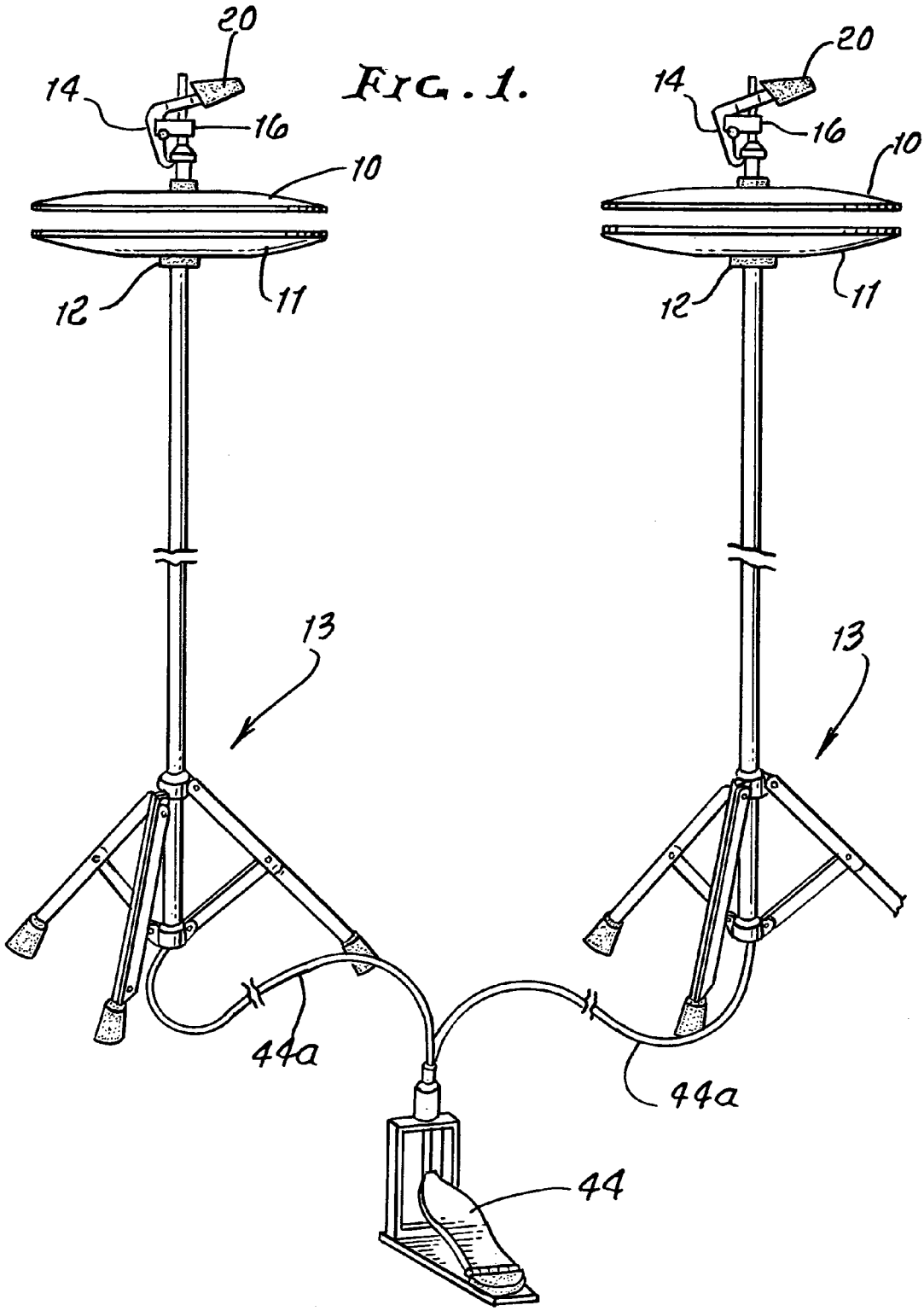
FIG. 1 shows two cymbals stands operated by a single pedal apparatus.

To retrieve the upper disc 10, rod 28 is lowered as by drummer's foot pedal actuation, (see actuator pedal 44 and cable 44*a* in FIG. 2) and thereby compressing spring 29 (see FIG. 3) normally urging the rod upwardly. Such downward rod movement carries lever 14 downwardly, and this allows the hook 18 to cam outwardly on tapered surface 23*a*', and to fit under the shoulder 22 in the hook position indicated at 18' in FIG. 2. Thereafter, when the pedal is released, the spring 29 pushes the rod 28, the lever 15 and the upper disc 10 upwardly to FIGS. 1 and 2 position.

A positioner 30 extending below the block 16, and about the rod, engages the upper surface 23*e* of 23*a* to stably position the sleeve and the upper cymbals, axially, relative to the rod. That positioner may include a felt ring 30*a*. Positioner 30 is adjustably rotatable, and has a threaded stem 30*b* engaging threading 32 in block 16. See FIG. 5. This axially adjusts the positioner. Rod 28 extends through 30*b*.

The method of use of the cymbals position control apparatus includes the steps:

a) manually deflecting the lever 14 to achieve release of the upper disc 10, to fall to a lower position adjacent the lower disc 11, b) lowering the rod 28 and lever 14 to achieve lever movement causing the hook 18 to hook under an edge of structure associated with the upper disc, and c) allowing the rod and lever to rise to elevate the upper disc to a predetermined upper position.

See U.S. Pat. No. 5,668,332.

Figure 9:
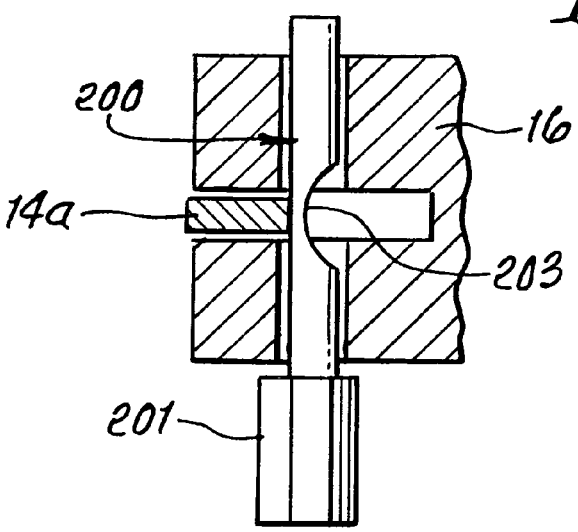
FIG. 9 is a section taken on lines 9—9 of FIG. 7.
Figure 10:
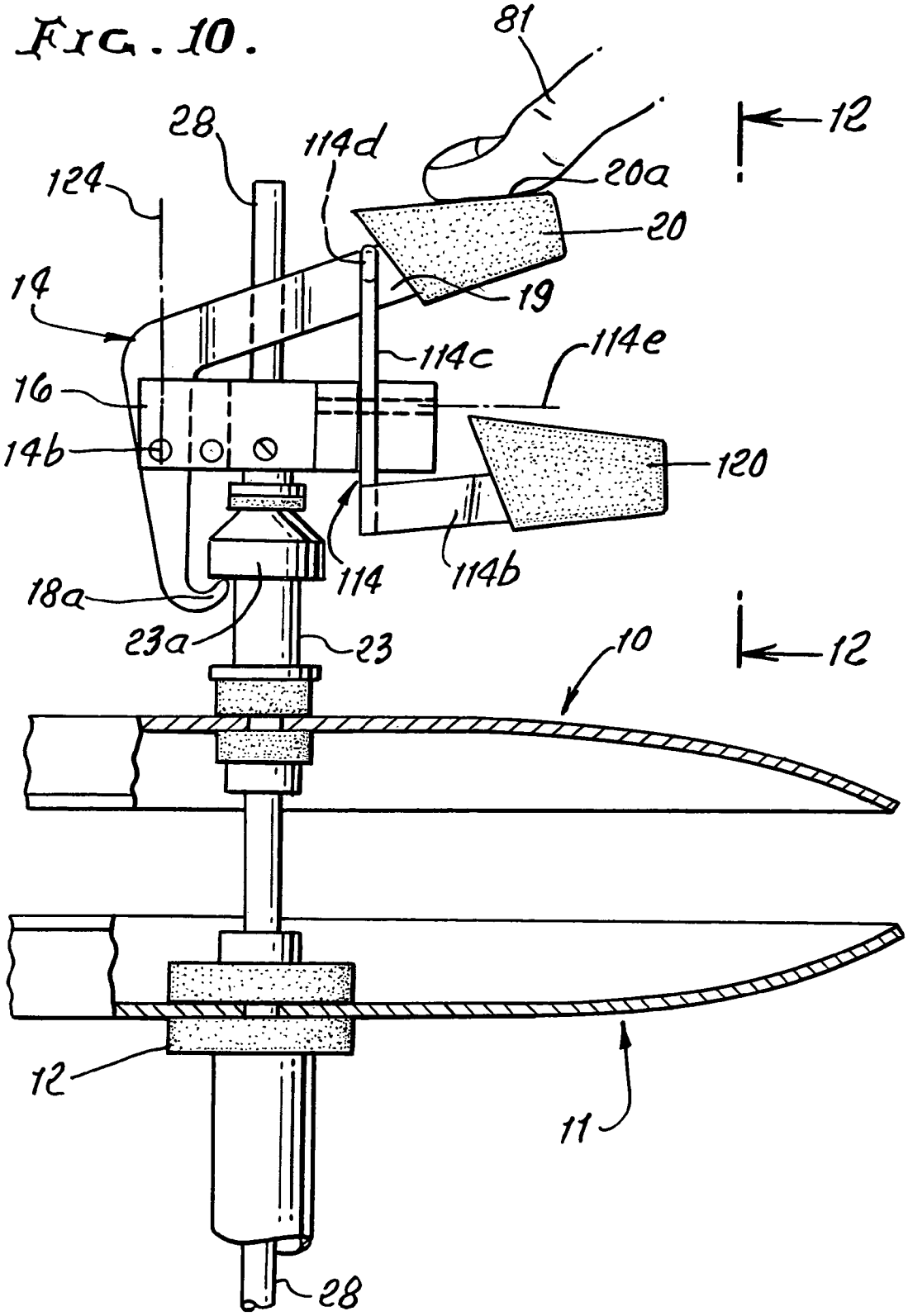
FIG. 10 is a view like FIG. 2 showing a modification, with controllable blocking of an upper cymbals sleeve.
Figure 11:
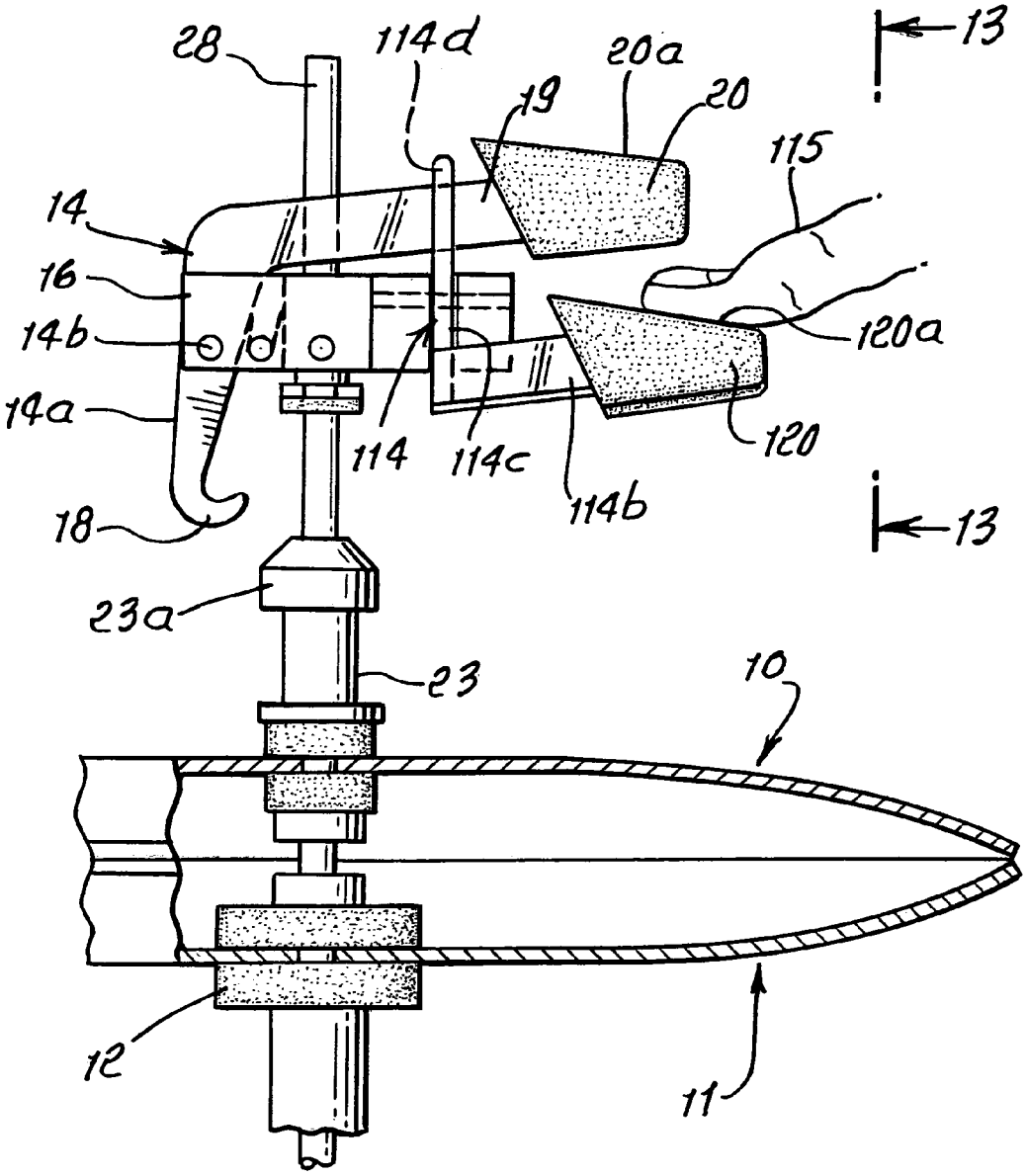
FIG. 11 is a view like FIG. 10, showing unblocked release of the upper cymbals sleeve.
Figure 12:
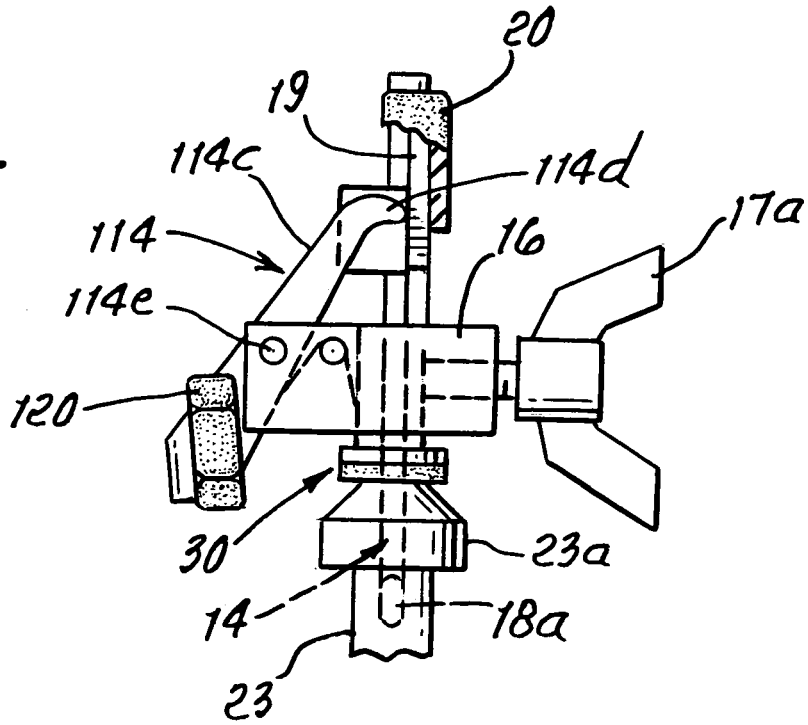
FIG. 12 is an elevation taken on lines 12—12 of FIG. 10.
Figure 13:
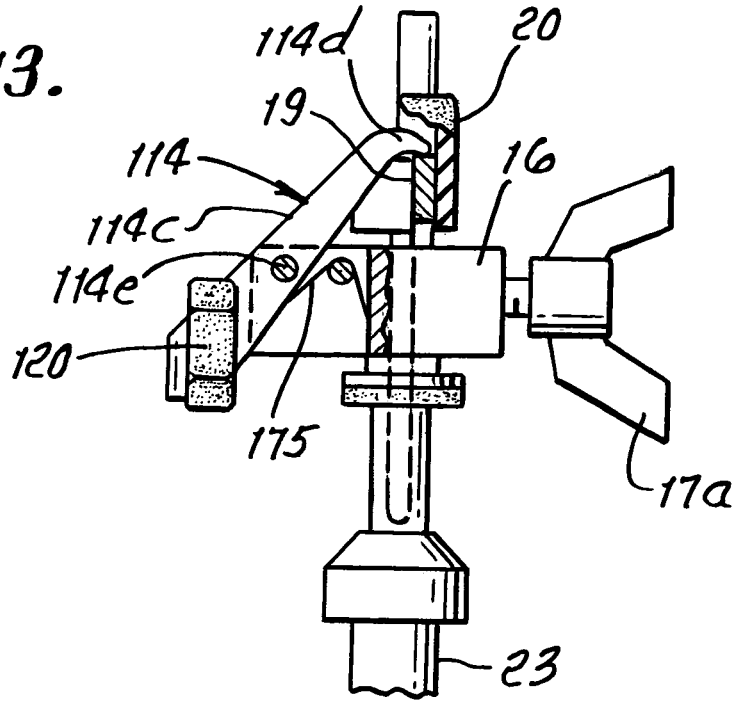
FIG. 13 is an elevation taken on lines 13—13 of FIG. 11.

It is another object of the invention to provide a simple and effective releasable device to block pivoting of the lever 14 from FIG. 2 position to FIG. 3 position. That device may comprise a pin 200 rotatable in block 16, into and out of blocking engagement with lever 14. Handle 201 on the pin enables such rotation. See FIGS. 7–9, and pin shoulder 203. That device may alternatively comprise a second lever 114 movable into and out of blocking position, as respects first lever 14. See preferred FIGS. 10–13. In this regard, the first lever 14 may have a first axis 14*b* of pivoting; the second lever may have a second axis 114*e* of pivoting; and those two axes may be spaced apart and skewed relative to one another, as seen in FIGS. 10 and 11. In these views, axis 14*b* is in a first vertical plane 124, and axis 114*e* extends generally normal to that plane. As previously described, a first handle 19 is provided on the first lever, and an enlargement 20 located on the handle and has a top surface 20*a* easily manually depressed. The second lever 114 has a projection 114*d* to be pivoted counterclockwise in FIG. 12 as when thumb or finger 115 pushes down on upper surface 120*a* of enlargement 120 on handle 114*b* of lever 114. In FIG. 10 position the levers keep the hook terminal 18*a* under sleeve 23 enlargement 23*a*, for retaining the upper cymbals disc 10 in raised position, i.e. spaced from lower cymbals disc 11. In this position, projection 114*d* on lever 114 extends in front of, or adjacent, the angled face 20*a* of enlargement 20. See also FIG. 12.

Second lever 114 has a handle portion 114*b* extending away from the swing plane of the second lever portion 114*c*, and also away from or offset from the swing plane, about axis 114*e*, of the enlargement 20 on the first lever 14. See FIGS. 12 and 13. When an enlargement 120 on handle portion 114*b* is manually elevated, the second lever 114 swings to FIG. 11 and FIG. 13 position, in which projection 114*e* is lowered away from enlargement face 20*a*, allowing 20 to be depressed, for swinging lever 14 to release the upper cymbals to fall to lowered position 10*a* seen in FIG. 11, clashing with cymbals disc 11. Thus, the second lever 114 serves as a controllable blocking device. Spring 175 urges lever 114 toward FIG. 13 position.

A support 16 attached to the rod 28 provides a pivoting locus for each of the two levers.

Apparatus embodying the invention may be defined as including a) mechanism including lever, a hook on the lever, and a handle on the lever to achieve release of the upper disc to drop toward a lower cymbals disc, b) means including a vertically movable upright rod to support said mechanism, and c) and a releasable device to block pivoting of the lever, and a foot pedal operatively connected to such apparatus to move a cymbals disc or discs unblocked by said releasable device or devices.

The releasable device may comprise a locking lever acting in one position to block pivoting of the first lever, and in a released position to unblock such first lever pivoting.

The apparatus is useful on each of two cymbals stands, operated as by a single foot pedal, whereby sleeve up-down movement on one rod can rapidly blocked, at either of the stands, or unblocked at both stands.

Position control apparatus of the invention for dual cymbals, includes a) first cymbals, and second cymbals, b) a foot pedal connected to operate the first and second cymbals, in unison or separately, c) first and second structures, operatively associated with the respective first and second cymbals, for operatively disconnecting one of the cymbals from operation by the foot pedal while the other of the cymbals remains operatively connected to the foot pedal.

I claim:

1. Cymbals operation control apparatus, comprising a) mechanism including a first lever, a hook on the lever, and a handle on the lever to achieve release of the upper disc to drop toward a lower cymbals disc, b) means including a vertically movable upright rod to support said mechanism, c) and a releasable device to block pivoting of the first lever, said device including a second lever, d) and wherein the first lever has a first axis of pivoting, the second lever has a second axis of pivoting, and said axes are spaced apart and in skewed relation to one another.

2. The combination of claim 1 wherein said second lever comprises a pin rotatable into and out of a position in which first lever rotation is blocked.

3. Cymbals operation control apparatus, comprising a) mechanism including a first lever, a hook on the lever, and a handle on the lever to achieve release of the upper disc to drop toward a lower cymbals disc, b) means including a vertically movable upright rod to support said mechanism, c) and a releasable device to block pivoting of the lever, said device including a second lever, d) and wherein the releasable device is rotatable and has a projection or shoulder rotatable into a position that interferes with first lever pivoting to block said pivoting of the first lever.

4. The combination of claim 3 wherein the second lever has a handle spaced from said projection.

5. The combination of claim 4 including a manually engageable enlargement on the handle of each lever.

6. The combination of claim 3 including a support attached to the rod, and pivotally supporting said first lever and said device.

7. The combination of claim 6 including a sleeve movable relative to and lengthwise of the rod, the sleeve carrying the upper cymbals.

8. The combination of claim 7 including stop means carried below said support, to engage the sleeve when the rod and handle are lowered toward a position for hook engagement with the sleeve to lift the upper cymbals.

9. Cymbals operation control apparatus, comprising a) mechanism including lever, a hook on the lever, and a handle on the lever to achieve release of the upper disc to drop toward a lower cymbals disc, b) means including a vertically movable upright rod to support said mechanism, c) and a releasable device to block pivoting of the lever, d) said device comprising a pin rotatable into and out of a position in which first lever rotation is blocked, e) and including a support attached to the rod, and pivotally supporting said first lever and said pin, said pin operable as a second lever said lever having a first axis of pivoting, (f) said device having a second lever, said second lever having a second axis of pivoting, and said axes are spaced apart and in skewed relation to one an other.

10. Multiple cymbals control apparatus, each apparatus comprising a) mechanism including a first lever, a hook on the lever, and a handle on the lever to achieve release of the upper disc to drop toward a lower cymbals disc, b) means including a vertically movable upright rod to support said mechanism, c) and a releasable device to block pivoting of the lever, and a foot pedal operatively connected to each apparatus to move a cymbals disc or discs controllably unblocked by said releasable device or devices, d) said device comprising a second lever, said releasable device being movable and having a projection movable into position that interferes with first lever pivoting to block said pivoting of the first lever said lever having a first axis of pivoting, (e) said device having a second lever, said second lever having a second axis of pivoting, and said axes are spaced apart and in skewed relation to one an other.

11. Position control apparatus, for dual cymbals, comprising in combination a) first cymbals, and second cymbals, b) a foot pedal connected to operate the first and second cymbals, in unison or separately, c) first and second structures, operatively associated with the respective first and second cymbals, for operatively disconnecting one of the cymbals from operation by the foot pedal while the other of the cymbals remains operatively connected to the foot pedal, d) said structures including first and second pivoting elements, the second element releasable to block pivoting of the first element said lever having a first axis of pivoting, (e) said device having a second lever, said second lever having a second axis of pivoting, and said axes are spaced apart and in skewed relation to one an other.

12. The combination of claim 11 wherein each of said first and second structures includes a rotary part operable to offset said operative disconnection.

* * * * *